US009918556B2

(12) United States Patent
Rawls-Meehan et al.

(10) Patent No.: US 9,918,556 B2
(45) Date of Patent: Mar. 20, 2018

(54) ADJUSTABLE BED FOUNDATION

(71) Applicant: ASCION, LLC, Bloomfield Hills, MI (US)

(72) Inventors: Martin B. Rawls-Meehan, Franklin, MI (US); Stephen A. Ratkowiak, Novi, MI (US); Qianyu Liang, Auburn Hills, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 234 days.

(21) Appl. No.: 14/995,887

(22) Filed: Jan. 14, 2016

(65) Prior Publication Data

US 2016/0206113 A1 Jul. 21, 2016

Related U.S. Application Data

(60) Provisional application No. 62/104,687, filed on Jan. 16, 2015.

(51) Int. Cl.

| | |
|---|---|
| ***A47C 20/04*** | (2006.01) |
| ***A61G 7/015*** | (2006.01) |
| ***A47C 21/00*** | (2006.01) |
| ***A47C 27/08*** | (2006.01) |
| ***A47C 27/10*** | (2006.01) |

(52) U.S. Cl.

CPC ..... *A47C 20/04* (2013.01); *A47C 20/041* (2013.01); *A47C 20/048* (2013.01); *A47C 21/003* (2013.01); *A47C 27/082* (2013.01); *A47C 27/10* (2013.01)

(58) Field of Classification Search

CPC ..... A61G 7/015; A61G 7/002; A61G 7/005; A47C 20/04

See application file for complete search history.

(56) References Cited

U.S. PATENT DOCUMENTS

| | | | | |
|---|---|---|---|---|
| 3,800,338 | A * | 4/1974 | Smith | A61G 7/015 297/377 |
| 4,685,160 | A * | 8/1987 | Rizzardo | A47C 19/005 5/201 |
| 5,165,129 | A * | 11/1992 | Rohm | A61G 7/015 5/613 |
| 7,321,811 | B1 | 1/2008 | Rawls-Meehan | |
| 7,465,280 | B2 | 12/2008 | Rawls-Meehan | |
| 7,805,785 | B2 | 10/2010 | Rawls-Meehan | |
| 7,930,783 | B2 | 4/2011 | Rawls-Meehan | |
| 7,933,669 | B2 | 4/2011 | Rawls-Meehan | |
| 7,979,169 | B2 | 7/2011 | Rawls-Meehan | |
| 8,019,486 | B2 | 9/2011 | Rawls-Meehan | |

(Continued)

*Primary Examiner* — Eric J Kurilla

(74) *Attorney, Agent, or Firm* — Marshall, Gerstein & Borun LLP

(57) ABSTRACT

The disclosure generally relates to an adjustable bed foundation. The adjustable foundation includes lateral and/or longitudinal support members as part of an adjustable base frame positioned below a mattress support. The lateral and longitudinal support members, along with a fixed base frame portion of the foundation are preferably formed from a lightweight material such as wood. The lateral and longitudinal support members provide sufficient vertical support structure to accommodate a mattress and bed occupants on the adjustable platform, as well as electrical and mechanical components of the adjustable foundation below a mattress support deck.

13 Claims, 17 Drawing Sheets

(56) References Cited

U.S. PATENT DOCUMENTS

| | | | | |
|---|---|---|---|---|
| 8,032,263 | B2 | 10/2011 | Rawls-Meehan | |
| 8,032,960 | B2 | 10/2011 | Rawls-Meehan | |
| 8,046,114 | B2 | 10/2011 | Rawls-Meehan | |
| 8,046,115 | B2 | 10/2011 | Rawls-Meehan | |
| 8,046,116 | B2 | 10/2011 | Rawls-Meehan | |
| 8,046,117 | B2 | 10/2011 | Rawls-Meehan | |
| 8,050,805 | B2 | 11/2011 | Rawls-Meehan | |
| 8,069,512 | B2 | 12/2011 | Rawls-Meehan | |
| 8,078,336 | B2 | 12/2011 | Rawls-Meehan | |
| 8,078,337 | B2 | 12/2011 | Rawls-Meehan | |
| 8,150,562 | B2 | 4/2012 | Rawls-Meehan | |
| 8,375,488 | B2 | 2/2013 | Rawls-Meehan | |
| 8,565,934 | B2 | 10/2013 | Rawls-Meehan | |
| 8,682,457 | B2 | 3/2014 | Rawls-Meehan | |
| 9,744,088 | B2 * | 8/2017 | Shih | A61G 7/018 |
| 9,757,294 | B1 * | 9/2017 | Lo | A61G 7/015 |
| 2005/0028281 | A1 * | 2/2005 | Ooyama | A61G 7/015 5/618 |
| 2005/0210588 | A1 * | 9/2005 | Loewenthal | A47C 19/04 5/618 |
| 2008/0000028 | A1 * | 1/2008 | Lemire | A61G 7/001 5/618 |
| 2008/0028535 | A1 * | 2/2008 | Rodrigues Moreira | A47C 20/04 5/722 |
| 2009/0178201 | A1 * | 7/2009 | Lujan | A47C 20/027 5/618 |
| 2012/0005828 | A1 * | 1/2012 | McCullar | A47C 20/041 5/412 |
| 2012/0057685 | A1 | 3/2012 | Rawls-Meehan | |
| 2013/0074266 | A1 * | 3/2013 | Wu | A61G 7/015 5/616 |
| 2014/0250600 | A1 * | 9/2014 | McCarty | A61G 7/015 5/617 |
| 2014/0259409 | A1 * | 9/2014 | Shih | A61G 7/002 5/600 |
| 2014/0325761 | A1 | 11/2014 | Rawls-Meehan | |
| 2014/0352068 | A1 * | 12/2014 | Xu | A47C 20/041 5/616 |
| 2015/0313369 | A1 * | 11/2015 | Tarplee | A61H 23/0254 601/57 |
| 2016/0022518 | A1 * | 1/2016 | Shih | A61G 7/018 5/616 |
| 2016/0128883 | A1 * | 5/2016 | Robertson | A61G 7/015 5/618 |
| 2016/0286970 | A1 * | 10/2016 | Robertson | A47C 20/041 |

* cited by examiner

ADJUSTABLE BED FOUNDATION

CROSS REFERENCE TO RELATED APPLICATION

Priority is claimed to U.S. Provisional Application No. 62/104,687 (filed Jan. 16, 2015), which is incorporated herein by reference in its entirety.

STATEMENT OF GOVERNMENT INTEREST

None.

BACKGROUND OF THE DISCLOSURE

Field of the Disclosure

The disclosure generally relates to an adjustable bed foundation. The adjustable foundation includes lateral and/or longitudinal support members as part of an adjustable base frame positioned below a mattress support.

Rawls-Meehan U.S. Publication No. 2014/0325761 is directed to an adjustable mattress support facility. In one aspect, an adjustable bed is disclosed in which only the head portion articulates, for example including a truss reinforcing structure.

SUMMARY

In one aspect, the disclosure relates to an adjustable bed foundation comprising: (a) a mattress support comprising (i) a first adjustable deck support section, and (ii) a second stationary deck support section adjacent the first adjustable deck support section (e.g., spaced apart by a small amount, but hingedly or pivotally attached to each other such as indirectly via the first adjustable support frame or skeleton frame); (b) an adjustable base frame positioned below the mattress support, the adjustable base frame comprising: (i) a fixed base frame (e.g., a plurality of base frame walls, defining the outer perimeter of the base frame and vertical extent of the base frame); (ii) a longitudinal support member spanning the fixed base frame (e.g., interior volume thereof; fixedly attached to fixed base fame, such as directly to end walls thereof or indirectly to end walls or other fixed base frame structure such as via brackets or other intermediate mounting means; longitudinal direction is major direction of bed); (iii) at least two lateral support members longitudinally spaced apart and spanning the fixed base frame (e.g., interior volume thereof; fixedly attached to fixed base fame, such as directly to side walls thereof or indirectly to side walls or other fixed base frame structure such as via brackets or other intermediate mounting means; lateral direction is major direction of bed); and (iv) a first adjustable support frame comprising a first support portion and a first articulating portion pivotally connected to the first support portion, the first support portion being mounted to at least one of the lateral support members (e.g., mounted to the lateral support member adjacent to the head section of the foundation/mattress support, and optionally to the lateral support member adjacent thereto in the bottom/leg section); and (c) a first actuator positioned below the mattress support, the first having a first end connected to the first support portion of the first adjustable support frame and a second end connected to the first articulating portion of the first support frame (e.g., where actuation of the first actuator articulates the articulation portion of the adjustable support frame, such as between a flat position and a fully extended position, or any position therebetween); wherein the first adjustable deck support section is mounted to the first articulating portion of the first adjustable support frame (e.g., defining an upper surface of the adjustable foundation configured to support a head portion of a mattress on the foundation); and the second stationary deck support section is mounted to the adjustable base frame and remains fixed in position relative to the fixed base frame (e.g., defining an upper surface of the adjustable foundation configured to support a bottom portion of a mattress on the foundation; mounted to one or more of the fixed base frame, support portion of the adjustable support frame, one or more lateral support members).

Various refinements of the adjustable foundation are possible.

In a refinement, the longitudinal support member is spaced below a top boundary of the fixed base frame; and the lateral support members are positioned between the longitudinal support member and the top boundary of the fixed base frame, the longitudinal support member being mounted to and providing vertical support to the lateral support members.

In a refinement, the lateral support members have a height less than that of the fixed base frame and are positioned to provide an open area between the lateral support members and a bottom boundary of the fixed base frame (e.g., lateral support members positioned at or near the top boundary of the fixed base frame and/or having a height about 50%, 25%, 10% or less of the fixed base frame height; open area below lateral support members providing operational area for actuator movement without obstruction).

In a refinement, the mattress support further comprises one or more additional stationary deck support sections mounted to the adjustable base frame and remaining fixed in position relative to the fixed base frame (e.g., an embodiment in which only the head portion can be adjusted between flat an articulated positions; additional support sections are adjacent to the main stationary deck support section in the bottom portion of the foundation, generally located in the leg and foot portion of the foundation).

In a refinement, the mattress support further comprises (iii) a third adjustable deck support section adjacent the second stationary deck support section; the adjustable base frame further comprises (v) a second adjustable support frame comprising a second support portion and a second articulating portion pivotally connected to the second support portion, the second support portion being mounted to at least one of the lateral support members (e.g., mounted to the lateral support member adjacent to the bottom/leg sections); the adjustable foundation further comprises (d) a second actuator having a first end connected to the first support portion of the first adjustable support frame and a second end connected to the second articulating portion of the second support frame (e.g., where actuation of the second actuator articulates the second articulation portion of the second adjustable support frame, such as between a flat position and a fully extended position, or any position therebetween); and the third adjustable deck support section is mounted to the second articulating portion of the second adjustable support frame (e.g., an embodiment in which both the head portion and the leg portion can be adjusted between flat an articulated positions). In a further refinement, the mattress support further comprises (iv) a fourth adjustable deck support section adjacent the third adjustable deck support section and is pivotally connected thereto (e.g., via hinge elements directly connecting the third and fourth adjustable deck support sections); the adjustable foundation further comprises at least a third lateral support member longitudinally spaced apart and spanning the fixed base frame; and the adjustable base frame further comprises (vi) a third adjustable support frame comprising a third support portion and a third articulating portion pivotally connected to the third support portion, the third support portion being mounted to at least one of the lateral support members (e.g., mounted to the lateral support member adjacent to the leg/foot sections; actuation of the second actuator and corresponding movement of the third adjustable support section also raises the fourth adjustable support section, such as in a generally horizontal but elevated position; an embodiment extended with a moving foot platform in addition to the moving leg platform).

In a refinement, one or more of the fixed base frame, the longitudinal support member, the lateral support members, and the mattress support (e.g., deck support sections thereof) comprises wood (e.g., any or all of the structures are formed completely or substantially from wood such as plywood, particle board, fiberboard, hardwood, or softwood).

In a refinement, the first, second, and/or third adjustable support frame comprises metal (e.g., formed completely or substantially from metal such as steel).

In another aspect, the disclosure relates to an adjustable bed foundation comprising: (a) a stationary deck having a top surface for supporting a mattress; (b) an adjustable head board positioned adjacent to the stationary deck at or near a pivot point, the headboard defining a top surface to further support a head portion of the mattress and being operable to pivot about the pivot point to a range of positions from a flat position, a raised position, and positions therebetween; (c) a substructure support assembly mounted directly below the stationary and head deck, the substructure comprising: (i) an actuator support structure mounted directly below the stationary deck; (ii) a head board support structure mounted directly below the head board and operable to pivot with the head board; (iii) two or more lateral support beams spaced apart and positioned below the stationary deck operable for supporting and mounting of the actuator support structure; and (iv) a longitudinal support beam generally bisecting the lateral support beams and extending the length of the stationary deck and head board and operable to support the lateral support beams and the head board and actuator support structures; and (d) an actuator mounted to the actuator support structure and connected to the head board support structure through a linkage and adapted to raise and lower the head board upon actuation.

Various refinements of the adjustable foundation are possible.

In a refinement, the longitudinal support beam is spaced below a top boundary of the substructure support assembly; and the lateral support beams are positioned between the longitudinal support beam and the top boundary of the substructure support assembly, the longitudinal support beam being mounted to and providing vertical support to the lateral support beams.

In a refinement, the lateral support beams have a height less than that of the substructure support assembly and are positioned to provide an open area between the lateral support beams and a bottom boundary of the substructure support assembly.

In a refinement, the longitudinal support beam, the lateral support beams comprises wood.

In a refinement, the head board support structure comprises metal.

In another aspect, the disclosure relates to adjustable bed comprising an adjustable bed foundation according to any of the various disclosed embodiments, and a mattress positioned on the foundation.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

Figure 1:
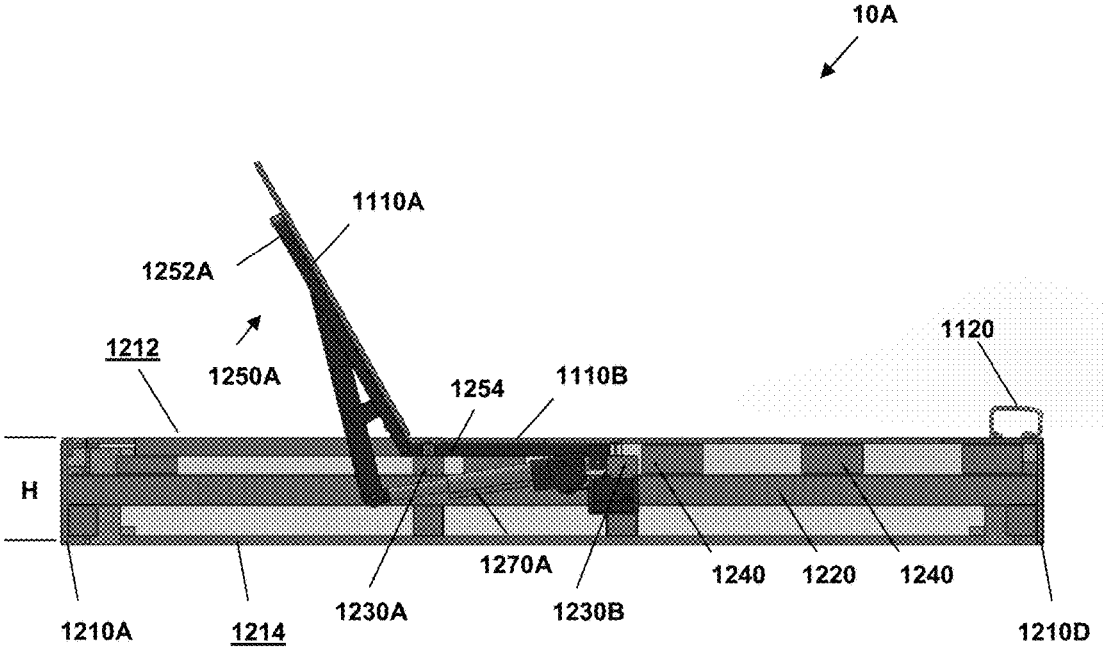
FIG. 1 is a side view of an adjustable foundation according to the disclosure in which only a head deck section is adjustable between a flat position and an articulated position.
Figure 2:
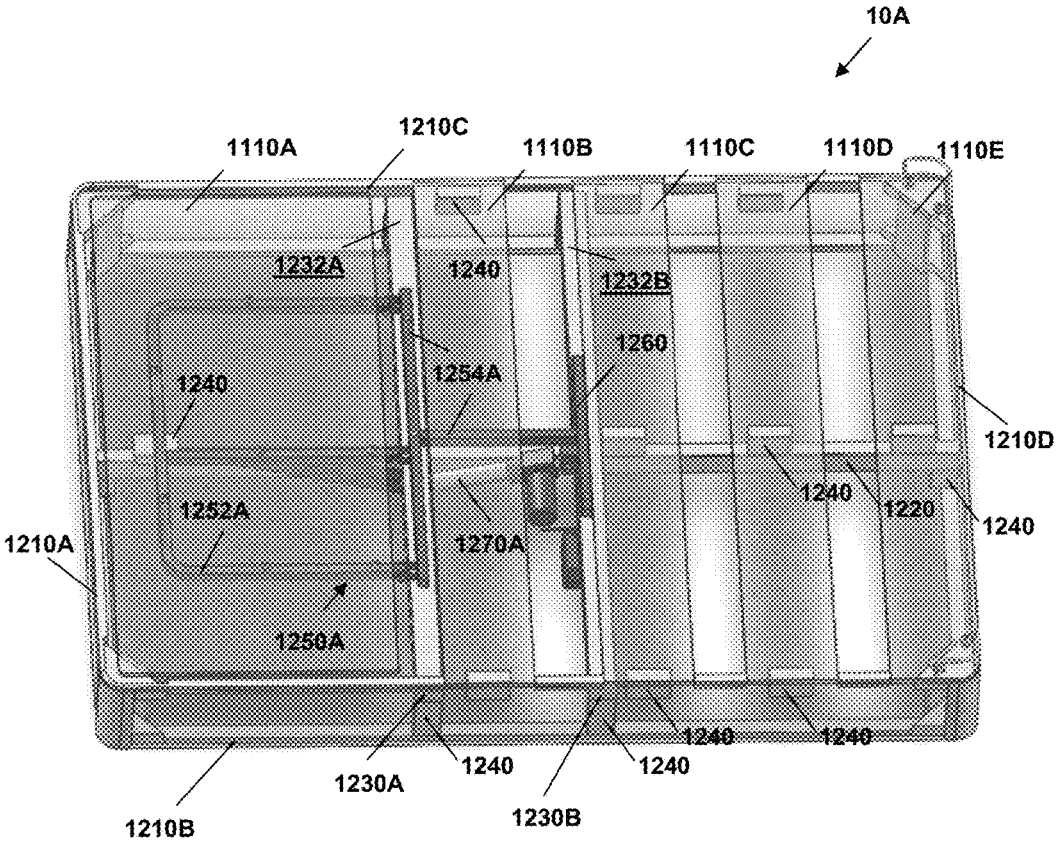
FIG. 2 is a top view of the adjustable foundation of FIG. 1, with the deck support sections shown as semi-transparent structures.
Figure 3:
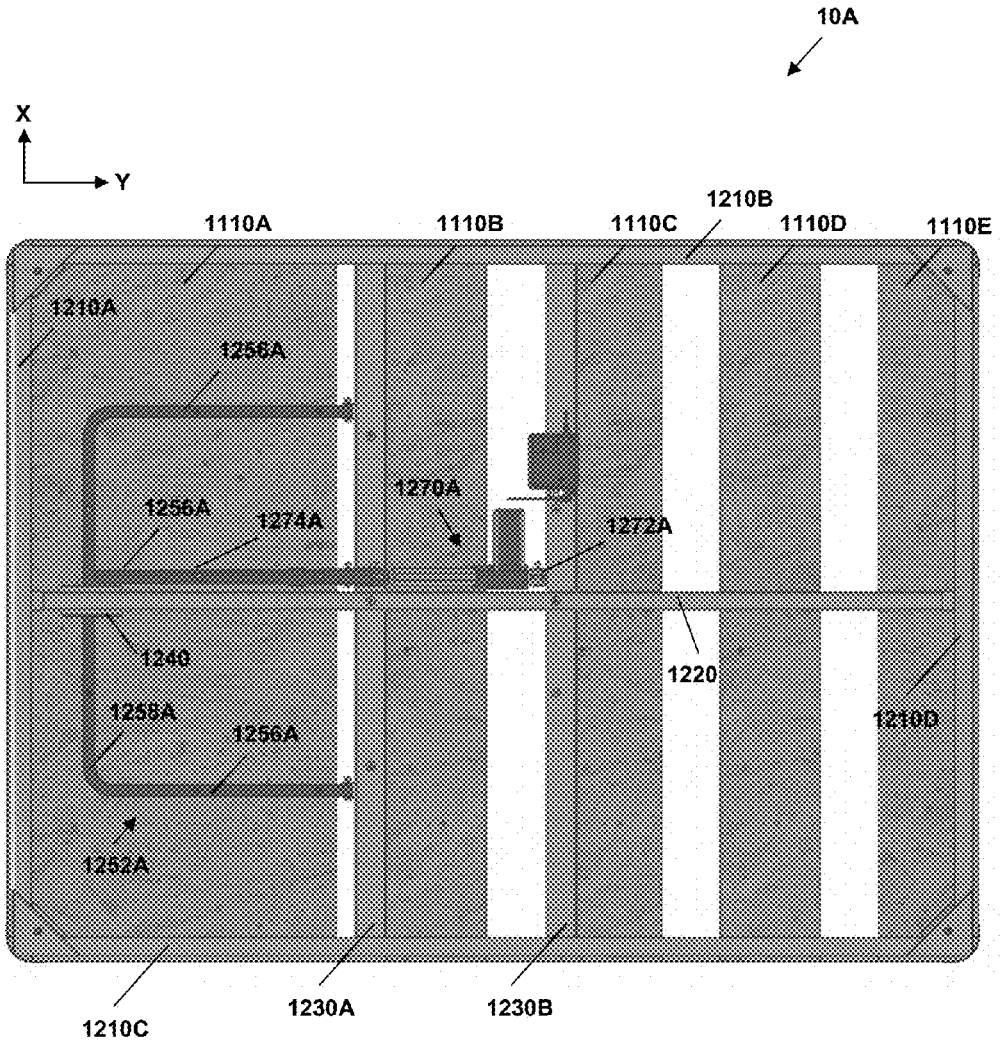
FIG. 3 is a bottom view of the adjustable foundation of FIG. 1, with the head section in a flat position.
Figure 4:
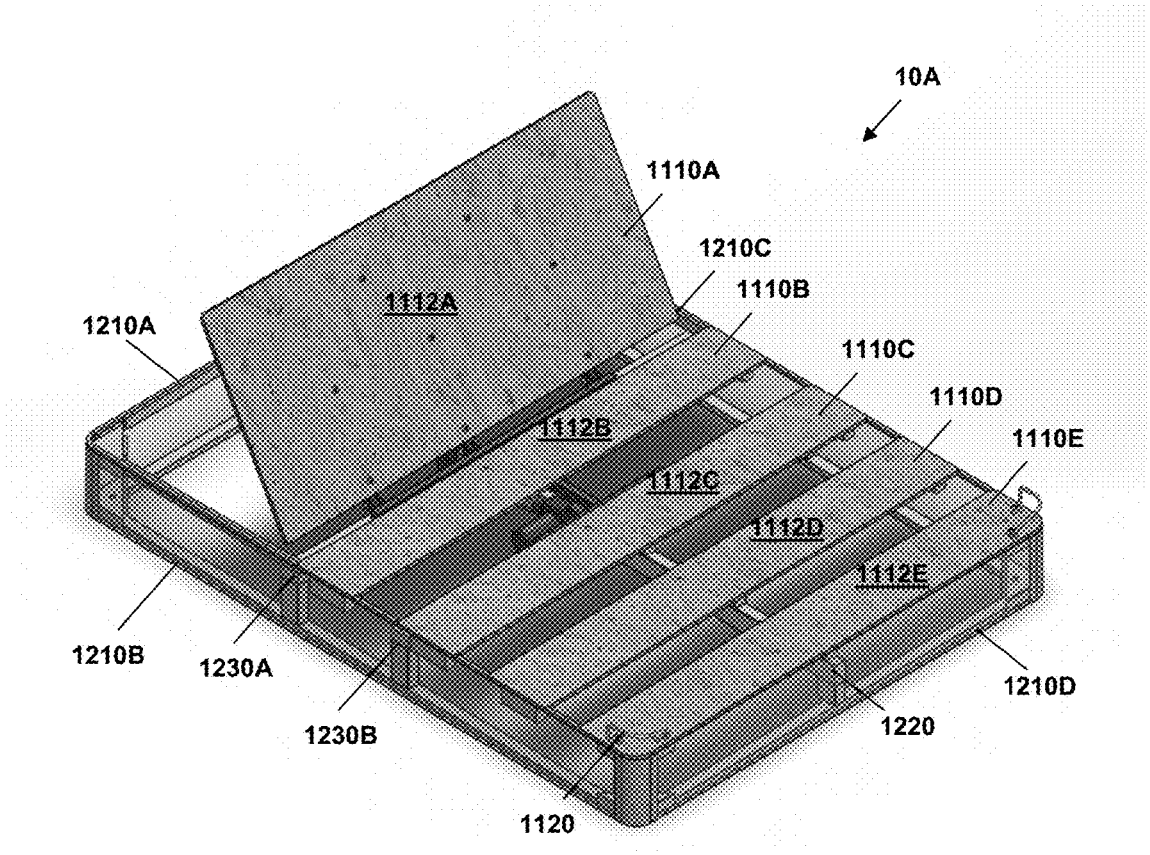
FIG. 4 is a top perspective view of the adjustable foundation of FIG. 1, with the head section in an articulated position.
Figure 5:
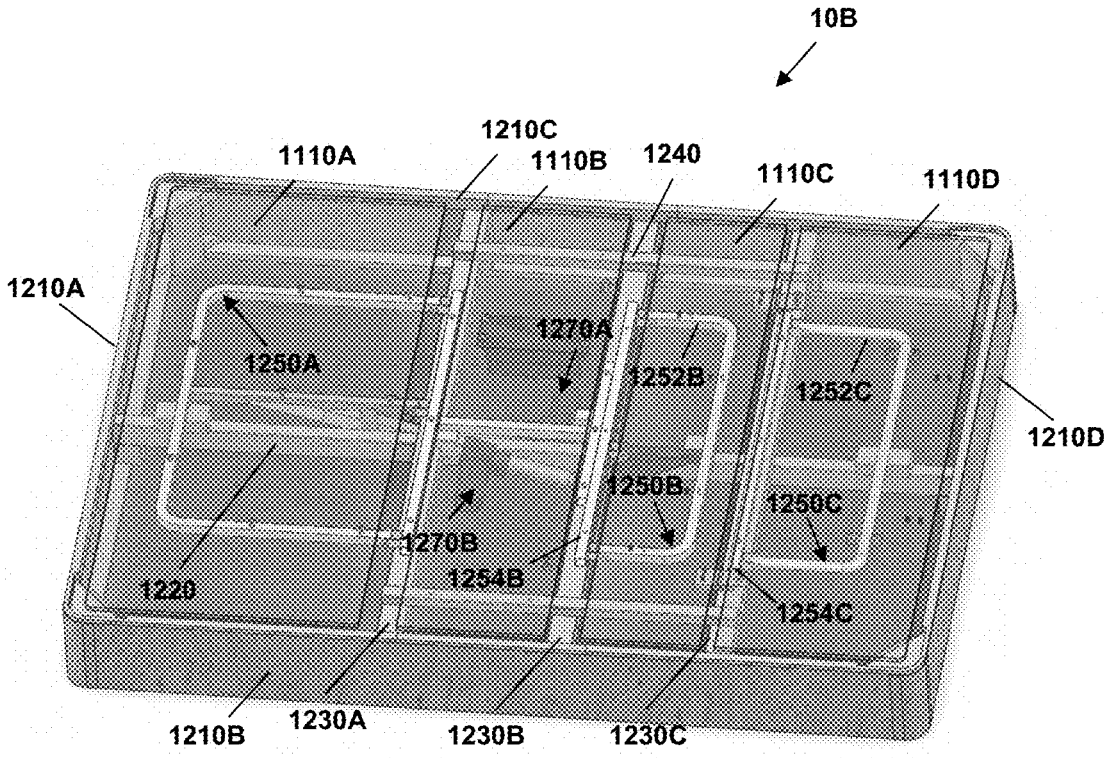
FIG. 5 is a top view of an adjustable foundation according to the disclosure in which both head and leg/foot deck sections are adjustable between a flat position and an articulated position, with the deck support sections shown as semi-transparent structures.
Figure 6:
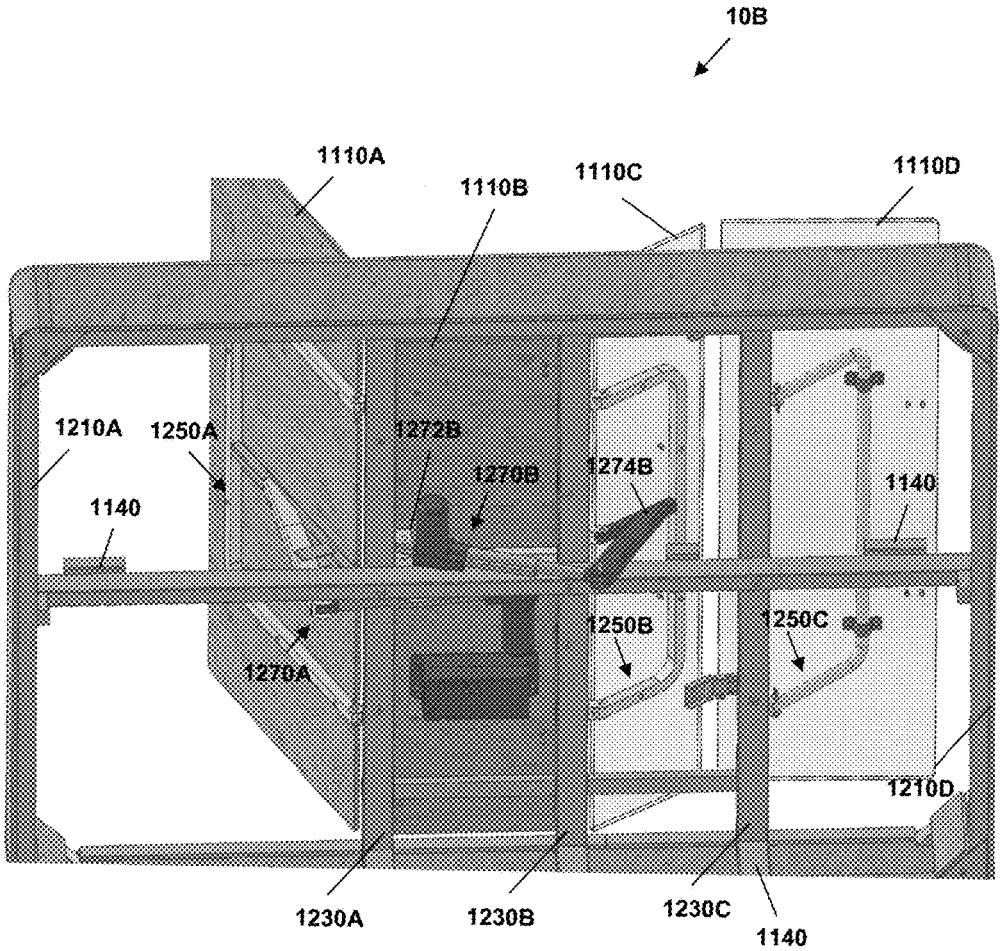
FIG. 6 is a bottom view of the adjustable foundation of FIG. 5, with the head, leg, and foot sections in articulated positions.
Figure 7:
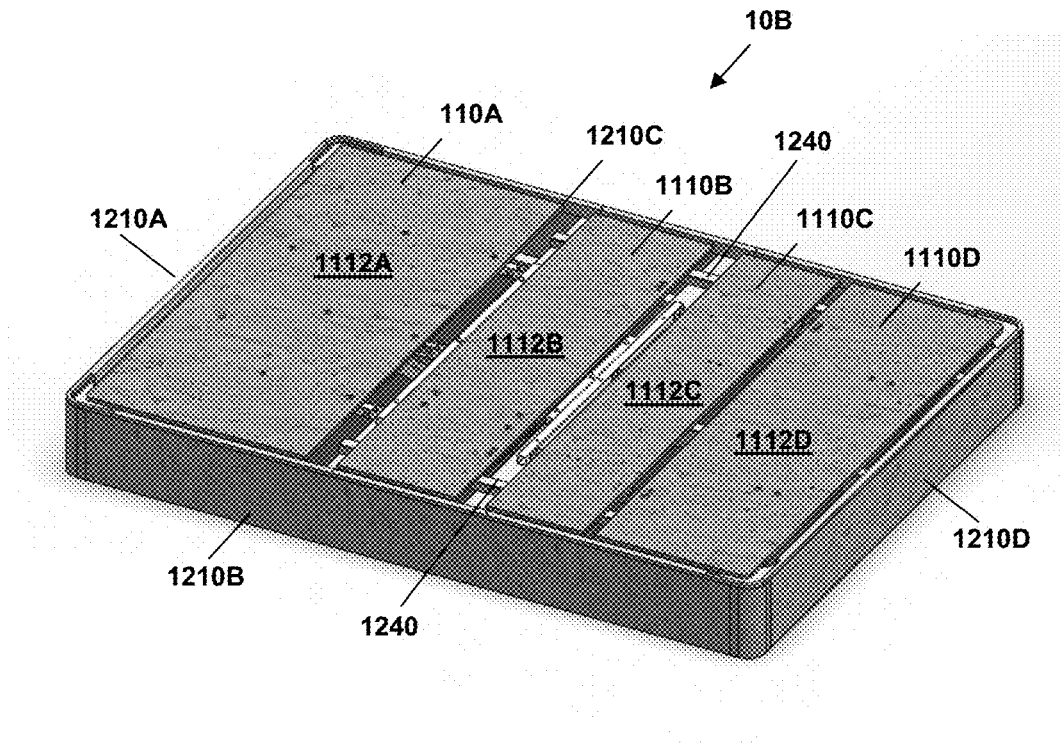
FIG. 7 is a top perspective view of the adjustable foundation of FIG. 5, with all deck support sections in a flat position.
Figure 8:
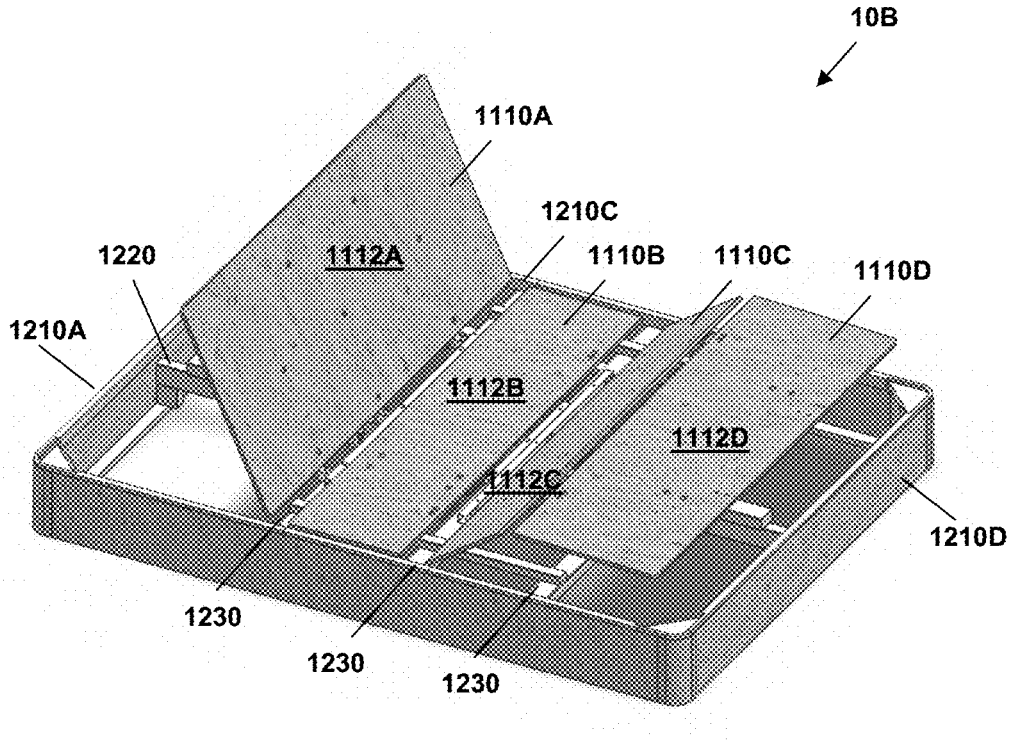
FIG. 8 is a top perspective view of the adjustable foundation of FIG. 5, with the head, leg, and foot sections in articulated positions.

While the disclosed apparatus and methods and are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

In the following description, terms such as "adjustable mattress," "adjustable bed," "adjustable bed facility," "adjustable bed apparatus," "adjustable bed foundation," and the like are used interchangeably to refer generally to an apparatus including a sleeping or resting surface with one or more adjustable or moveable sub-surfaces that can be positioned for user comfort and/or convenience, unless a specific meaning is explicitly provided or otherwise clear from the context. Aspects of the disclosure may be described as an adjustable bed, but it may be understood that the same aspects may be applied to other rest facilities that may include a bed, a couch, a chair, or the like. Such rest facilities may be in a home, a car, a recreational vehicle, a cruise ship, an airline, a train, or anywhere that a user required them, and they may be fixed or mobile.

Adjustable Bed Foundation

The disclosure generally relates to an adjustable bed foundation. The adjustable foundation includes lateral and/or longitudinal support members as part of an adjustable base frame positioned below a mattress support. The lateral and longitudinal support members, along with a fixed base frame portion of the foundation are preferably formed from a lightweight material such as wood. The lateral and longitudinal support members provide sufficient vertical support structure to accommodate a mattress and bed occupants on the adjustable platform, as well as electrical and mechanical components of the adjustable foundation below a mattress support deck (e.g., one or more actuators, a power supply, an adjustable bed controller such as a programmable logic controller).

FIGS. 1-4 illustrate an adjustable foundation (or adjustable mattress support facility) 10A according to the disclosure in which only a head deck section is adjustable between a flat position and an articulated position. The foundation 10A includes a mattress support (or deck) 1100 positioned above an adjustable base frame (or substructure support assembly) 1200.

The mattress support 1100 includes a plurality of deck support sections 110 having a top surface 1112 (e.g., atop which a mattress sits during use), for example sections 1110A-1110E as illustrated. The first section 1110A generally corresponds to the head section of the support 1100, and it is mounted to an articulating portion of an adjustable support frame (described below). The second through fifth sections 1110B-1110E generally correspond to the bottom, first leg, second leg, and foot support or board portions of the support 1100. The sections 1110B-1110E stationary and mounted in a fixed position relative to the adjustable base frame 1200 (e.g., mounted to end walls thereof, side walls thereof, lateral support members thereof, longitudinal support members thereof, and/or vertical support members thereof). As further illustrated, a mattress retainer bar 1120 can be mounted to the support 1100, for example on the foot section 1110E as shown.

The adjustable base frame 1200 includes a fixed base frame 1210, for example including longitudinally opposed head 1210A and foot 1210D end sections and laterally opposed side 1210B, 1210C sections, which mounted to each other or otherwise connected at the corners (e.g., with screws, brackets, nails, staples, or other fastening means). The fixed base frame 1210 has height H defined between a top surface or boundary 1212 and a bottom surface or boundary 1214. The adjustable base frame 1200 includes a longitudinal support member 1220 extends along the longitudinal direction Y, and it is suitably mounted to the end walls 1210A, 1210D of the fixed base frame 1210. The adjustable base frame 1200 includes two or more lateral support members 1230, for example first and second members 1230A, 1230B positioned approximately at the boundary between the head and bottom sections of the foundation 10A (member 1230A) and at the boundary between the bottom and leg sections of the foundation 10A (member 1230B). The lateral support members 1230 have a top surface 1232 and a bottom surface 1234; as shown, the lateral support members 1230 are mounted to the longitudinal support member 1220 at their bottom surface 1234. The lateral support members 1230 suitably have a height which is less than the height H of the fixed base frame 1210, thereby providing an open area within the fixed base frame 1210 for one or more actuators 1270 to operate in the longitudinal direction without obstruction. One or more vertical support members 1240 can be variously mounted to the fixed base frame 1210, the longitudinal support member 1220, and/or the lateral support members 1230 to provide spacers and vertical support for the mattress support 1100 mounted above the adjustable base frame 1200.

The adjustable base frame 1200 further includes a (metal) adjustable support or skeleton frame 1250, for example a first adjustable support frame 1250A generally positioned in the head and bottom section of the foundation 10A. The adjustable support frame 1250 includes an articulating portion 1252 pivotally or hingedly attached to a (fixed) support portion 1254 (e.g., a central or support portion mounted beneath a deck section 1110, such as (stationary) bottom section or a (stationary or adjustable) leg or foot section), which further provides an attachment or linkage point for an actuator 1270. The articulating portion 1252 includes one or more longitudinal frame members 1256 and one or more lateral frame members 1258. The articulating portion 1252A is mounted to the head deck support section 1110A. The adjustable base frame 1200 also includes a (metal) support structure 1260 (e.g., bar, bracket, etc.) connected to the support portion 1254A of the adjustable support frame 1250A. The adjustable support frame 1250A is mounted to one or more lateral support members 1230, for example at the top surface of the first support member 1230A, and the support structure 1260 is mounted to one or more lateral support members 1230, for example at the top surface of the second support member 1230B (in addition to being connected to the support portion 1254A).

The adjustable base frame 1200 further includes an actuator 1270 to articulate the adjustable support frame 1250 between flat an raised positions, for example a first actuator 1270A generally positioned in the head and bottom section of the foundation 10A. The actuator 1270 includes first and second ends 1272, 1274. The first end 1272A of the first actuator 1270A is pivotally connected to the support portion 1254A of the first adjustable support frame 1250A, and the second end 1274A is pivotally connected to the articulating portion 1252A of the first adjustable support frame 1250A. As illustrated, linear extension of the actuator 1270A raises the articulating portion 1252A of frame 1250A (i.e., and correspondingly the head section 1110A of the support 1100). Similarly, linear retraction of the actuator 1270A lowers the articulating portion 1252A of frame 1250A (i.e., and correspondingly the head section 1110A of the support 1100).

FIGS. 5-8 illustrate an adjustable foundation 10B according to the disclosure in which the head, leg, and foot deck sections are adjustable between a flat position and an articulated position. Analogous structures in foundations 10A and 10B are labeled with like numerals. Instead of stationary deck sections 1110 in the leg and foot sections of the mattress support 1100, however, the foundation 10B includes a third (leg) support section 1110C and a fourth (foot) support section 1110D hingedly attached to the section 1110C, both of which are adjustable. The foundation 10B includes a third lateral support member 1230C positioned approximately at the boundary between the leg and foot sections of the foundation 10B. The foundation 10B additionally includes a second adjustable support frame 1250B generally positioned in the leg section of the foundation 10B and a third first adjustable support frame 1250C generally positioned in the foot section of the foundation 10B. The second adjustable support frame 1250B includes an articulating portion 1252B pivotally or hingedly attached to a (fixed) support portion 1254B, which is mounted to the second support member 1230B. The third (leg) support section 1110C is mounted to the articulating portion 1252B. The third adjustable support frame 1250C includes an articulating portion 1252C pivotally or hingedly attached to a (fixed) support portion 1254C, which is mounted to the third support member 1230C. The fourth (foot) support section 1110D is pivotally mounted to the articulating portion 1252C. The foundation 10B additionally includes a second actuator 1270B, with the first end 1272B being pivotally connected to the support portion 1254 of the first adjustable support frame 1250A (e.g., at or near the first support member 1230A), and the second end 1274B being pivotally connected to the articulating portion 1252B of the second adjustable support frame 1250B. As illustrated, actuation of the actuator 1270A raises or lowers the articulating portion 1252B of second frame 1250B (i.e., and correspondingly the leg section 1110C of the support 1100), and it also raises or lowers the articulating portion 1252C of third frame 1250C (i.e., and correspondingly the foot section 1110D of the support 1100 in a generally raised or lowered horizontal orientation).

Adjustable Bed Facility

Figure 9:
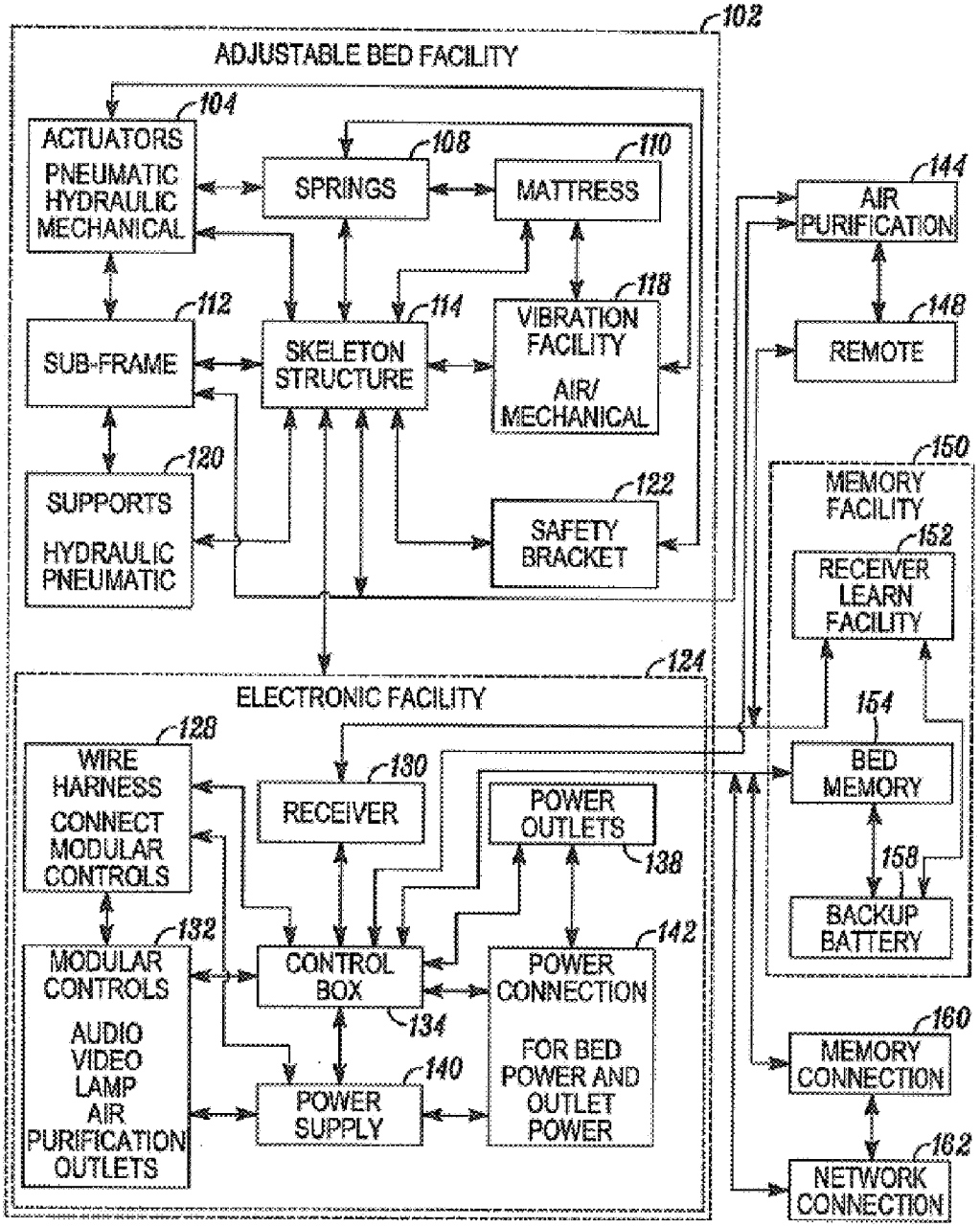
FIG. 9 shows a block diagram of an adjustable bed facility and associated components.

A block diagram of the various components of an adjustable bed facility 102 is shown in FIG. 9. In an embodiment, an adjustable bed facility 102 may be made up of a number of devices and facilities that may include actuators 104, springs 108, mattresses 110, a sub-frame 112, a skeleton structure 114, vibration motors 118, supports 120, safety brackets 122, an electronic facility 124, an air purification facility 144, a remote 148, a memory facility 150, a memory connection 160, a network connection 162, and the like. In an embodiment, the electronic facility 124 may include a wire harness 128, a receiver 130, modular controls 132, a control box 134, power outlets 138, a power supply 140, a power connection 142, and the like. In an embodiment, the memory facility 150 may include a receiver learn facility 152, bed memory 154, a backup battery 158, and the like. In an embodiment, the receiver learn facility 152, bed memory 154, and backup battery 158 may not be part of the memory facility 150, but may be combined into other facilities or devices, be stand-alone devices, or the like.

In an embodiment, the physical aspects of the adjustable bed facility 102 that provide support for the user may include the actuators 104, springs 108, mattresses 110, a sub-frame 112, a skeleton structure 114, vibration motors 118, supports 120, and safety brackets 122.

In an embodiment, the skeleton structure 114 may provide the central structure that the other physical aspects may interact with. In an embodiment, the skeleton structure 114 may provide direct support to the mattress 110, springs 108, and the like. In an embodiment, the skeleton structure 114 may be a lightweight frame structure that may provide both the strength and rigidity required to properly support the mattress 110 and springs 108. In embodiments, the skeleton structure 114 may use materials that include metal, plastic, wood, or the like; the materials may be used individually or in combination. In an embodiment, the skeleton structure 114 may include more than one section/frame. The sections/frames may be fixed or may be adjustable/movable. Further, the sections/frames may be assembled together to form the skeleton structure 114 in such a way that the sections/frames may be able to move relative to each other to provide the various bed positions required by the user.

In an embodiment, springs 108 may be used with a mattress 110, instead of a mattress 110, or the like. In an embodiment, the springs may be a standard bed spring system (e.g. coils within a wire framework), individual coil springs, individual foam springs, air springs, or the like. In an embodiment, the individual springs (e.g. coil, foam, or air) may be used to provide variable firmness to provide comfort to the user. For example, the springs 108 may be less firm or firmer in a local area to provide the user with the support that may be required for a body location that is experiencing discomfort (e.g. a hip, shoulder, back, neck). Springs that may have local firmnesses will be described in more detail below.

In an embodiment, the mattress 110 may include foam, feathers, springs 108, material, or the like. In an embodiment, the different materials may be used individually or in combination. The mattress may be intended to provide the user with a firmness that provides for the comfort requirements of the user.

In an embodiment, the mattress 110 may be an air mattress 110. In an embodiment, the air mattress 110 may be constructed using a single chamber, a plurality of chambers, a plurality of individual chambers, a combination of chamber shapes, or the like. In an embodiment, the air mattress 110 may be inflated to various pressures that may provide the user with the desired comfort level. In an embodiment, there may be separate air mattresses 110 for each of the adjustable bed facility 102 sections. For example, there may be separate air mattresses 110 for the head, torso, and foot sections of the adjustable bed facility 102. In an embodiment, the inflation pressure of the individual air mattresses 110 may be different from each other depending on user settings.

In an embodiment, the adjustable bed facility 102 sections may each contain individual air mattresses 110. For example, the head, torso, and foot sections may each have individual air mattresses that may be individually controlled for air pressures and therefore firmness. In an embodiment, the user may be able to control the firmness of the individual air mattresses 110 using a remote 148. In an embodiment, the remote 148 may have indicators for each of the firmness adjustable air mattresses 110. For example, the remote 148 may have keys for increasing or decreasing the pressures of the individual air mattresses 148. Using the remote 148, the user may be able to adjust the firmness of the adjustable bed facility sections.

In an embodiment, the air mattress 110 may use a common air supply source facility as an air actuator 104. In an embodiment, a control box 134 may control both the air mattress 110 and air actuator 104. The control box 134 may provide controlling commands to both the air mattress 110 and air actuators.

In an embodiment, the skeleton structure 114 may have structural members that support the mattress 110 and springs 108 and may also provide support and connections for the actuators 104, sub-frame 112, supports 120, vibrator motors 118, safety bracket 122, and the like. In an embodiment, the structural members may be positioned on the peripheral edges of the mattress 110 and springs 108 to provide overall support and rigidity to the mattress 110 and springs 108 and may form the base of the individual adjustable bed facility 102 sections. Additionally, there may other structural members as support, cross pieces, or the like that may provide additional support to the mattress 110 and springs 108 as may be required. A person knowledgeable in the art may understand that the frame structure may have many different construction configurations to provide support and rigidity to the mattress 110 and springs 108.

In an embodiment, the skeleton structure 114 may include more than one section/frame. The sections/frames may be fixed or may be adjustable or movable. Further, the sections/frames may be assembled together to form the skeleton structure 114 in such a way that the sections/frames may be able to move relative to each other to provide the various bed positions required by the user. To achieve this, the sections/frames may be connected together using hinges or like devices that allow a freedom of motion between them.

In embodiments, the frames may be made of square tubular steel bars/pipes or any other material capable of providing required strength to the frames. In preferred embodiments, each frame may include two substantially parallel side frame members connected by one or more connector frame members. In order to connect the parallel side frame members, various joining methods such as welding, brazing, riveting, fastening with nuts, and the like can be used. For example, the center frame may include two substantially parallel side frame members connected by two substantially parallel connector frame members. The two connector frame members may be located within approximately a center one-third of the length of the side frame members. Once the frame members have been connected to each other using any one of the joining methods as discussed above, the center frame may take a substantially square or rectangular shape. Those skilled in the art would appreciate that the frames may have various other shapes and designs to perform the same functionality and without deviating from the scope of the invention.

In an embodiment, the skeleton structure 114, as part of each adjustable bed facility 102 frame/section, may also provide support and connection members for the components that may be used to move the various adjustable bed facility 102 sections. There may be skeleton structure 114 members that provide connection support to the actuators 104, supports 120, safety brackets 122, vibration motors 118, and the like. These support and connection members may have any shape or configuration required to provide the support and connections needed by the various other components. For example, in addition to the skeleton structure 114 that is used to provide support to the mattress 110 and springs 108 there may be at least one cross member that may provide a connection to the actuator 104 and safety bracket 122.

In an embodiment, the skeleton structure 114 and the sub-frame 112 may interface with each other; the sub-frame 112 may provide structural support and a rigid foundation base to the skeleton structure 114. In an arrangement of this embodiment, only one frame of the skeleton structure 114 may be attached with the sub-frame 112. For example, the center frame may be rigidly attached to the sub frame 112 in such a manner that the center frame may not move with respect to the sub frame 112. The sub-frame 112 may provide a base to solidly connect the center frame to provide a fixed non-moving section. The other moveable frames such as the head frame and the foot frame may be moveably connected to the fixed center frame and additionally supported by the sub-frame 112 using a moveable interface connection.

In an embodiment, the sub-frame 112 may be a structural support frame in contact with the floor and may include the floor legs, connections for the actuators 104, connections for the supports 120, support for the skeleton structure 114, and the like. In an embodiment, the sub-frame 112 materials may include wood, metal, plastic, and the like. In an embodiment, the sub-frame 112 may provide a support interface to the skeleton structure 114 and may support the freedom of motion for the skeleton structure 114. For example, the sub-frame 112 may include an interface such as a track, surface, groove, slot, or the like in which the skeleton structure 114 may interface and use as a guide while providing motion support for the various adjustable bed facility 102 sections. In an embodiment, the sub-frame 112 interface may be a "C" channel in which the skeleton structure 114 may have interfacing wheels to move within the "C" channel during the adjustable bed facility 102 section movements.

In an embodiment, the actuator 104 may use electric motors and mechanical gears, pneumatic pressure, hydraulic pressure, pneumatic spring, air spring, hydraulic spring or the like to provide the force to extend and retract the actuator 104. The action of extending and retracting the actuator 104 may move the various movable bed sections up or down. By the actuator 104 pushing against the section, the section may rotate upward around the pivot point provided by the hinge type connection. In the same manner, by the actuator 104 pulling against the section, the section may rotate downward around the pivot point provided by the hinge type connection. In an embodiment, there may be at least one actuator 114 for every moveable adjustable bed facility 102 section.

In an embodiment, there may be at least one vibration motor 118 that may provide vibration and massage functions to the adjustable bed facility 102 sections and mattresses 110. In an embodiment, there may be vibration motors 118 associated with any of the adjustable bed facility 102 sections. In an embodiment there may be more than one vibration motor 118 for each adjustable bed facility 102 section that may have vibration motors 118. In an embodiment, using the remote 148, the user may be able to control the vibration mode of the various vibration motors 118; the mode may include the vibration setting for a particular bed section, the vibration frequency of at least one of the vibration motors, stopping the vibration of at least one of the vibration motors, or the like. In an embodiment, the vibration motors 118 may be operated independently or in combination. In an embodiment, the user may select a vibration mode on the remote 148 and the control box 134 may use a software application to control the various vibration motors 118 to the user's request.

In an embodiment, the vibration motor 118 may be an electric/mechanical device, a pneumatic device, a hydraulic device, or the like. The mechanical device may use an electric motor to rotate an offset mass to create a vibration;

the vibration motor may be controlled for vibration frequency and amplitude by the speed of rotation of the electric motor.

In an embodiment, the adjustable bed facility 102 may have an electronic facility 124 that may contain components that provide control of the physical aspects of the adjustable bed facility 102 (e.g. actuator, vibration motors), interface with the remote 148, interface with networks, interface with bed memory 154, control electronic devices of the adjustable bed facility 102, and the like.

In an embodiment, the control box 134 may coordinate the electronic requirements of the electronic facility 124. In an embodiment, the control box 134 may interface with the receiver 130, remote 148, air purification facility 144, power outlets, power connection 142, power supply 140, modular controls 132, wire harness 128, and the like. In an embodiment, the control box 134, receiver 130, and power supply 140 may be mounted directly to the skeleton structure 114. The control box 134, receiver 130 and the power supply 140 may be mounted on the center frame.

In an embodiment, the control box 134 may receive its command request from the user requesting adjustable bed facility 102 functions using the remote 148. In an embodiment, the remote may communicate to the receiver 130 and the receiver may transmit the received user command request to the control box 134. In an embodiment, the receiver 130 and control box 134 may be individual devices or a combined device.

In an embodiment, the remote 148 and receiver 130 may have wired or wireless communication. In an embodiment, the wireless communication may be by radio frequency (RF), infrared (IR), Bluetooth, or the like. In an embodiment, the receiver 130 may receive the user commands from the remote 130 and transmit the same command to the control box 134; the receiver may not provide any interpretation of the remote 148 commands. In an embodiment, the remote 148 and receiver 130 may be communication matched by the use of a code key. The code key may be any indicator that may be interpreted by the remote 148 and receiver 130 that commands may be received and executed between the remote 148 and receiver 130. In embodiments, the code key may be a number, a word, a serial number, a bed identification, a remote identification, a user identification, or any other identification known to both the remote 148 and receiver 130, all an indication that communications should be received. The code key may be transmitted as the beginning of the communication, the end of the communication, as part of the communication or the like.

In an embodiment, the remote 148 may be a user controlled device to provide control commands to the control box 134 to command certain functions of the adjustable bed facility 102. In an embodiment, the certain functions may be adjustable bed facility section movement (e.g. up or down), vibration control, modular controlled 132 devices, or the like. In an embodiment, the remote 148 may communicate with the control box using wired communication, wireless communication, or the like. In an embodiment, the wireless communication may use a radio frequency (RF), infrared (IR), Bluetooth, or the like. If the remote communicates using a wireless technology, the communication may be with the receiver 130 and the receiver 130 may pass the command request to the control box 134.

Adiustable Bed Foundation—Additional Embodiments and Features

FIGS. 10A-18E all depict additional embodiments and refinements for an adjustable bed where only the head portion articulates. In certain embodiments described with respect to these figures, a truss is included for reinforcing the structure, however, embodiments of the adjustable bed where only the head portion articulates may not require a truss for stability, such as in FIG. 12. The adjustable bed in these embodiments resembles a flat foundation, however, in this case, a head board portion of the base frame can pivot when commanded to do so to raise a head portion of a mattress placed on top of the adjustable bed. The head board portion may pivot along a pivot point that may be in a top one-third of the base frame. In other embodiments, the head board portion may pivot along a pivot point that may be in a center one-third of the base frame. The base frame may form a box that completely encloses the adjustable mechanism for the bed including the center frame, head frame, actuator, and the like. In embodiments, the base frame may be made from wood. The base frame may be covered with fabric. Additionally, the head board portion of the base frame may also be covered with fabric. In its articulated position, fabric may conceal all of the inner workings of the adjustable bed. In embodiments, foam may be disposed along the perimeter of the head board portion to cushion the interface of the head board with the surface of the base frame. In embodiments, the actuator may be a push-only motor to elevate the head board portion. In order to return to a flat position, the user may need to exert a pressure on the head board.

Figure 10A:
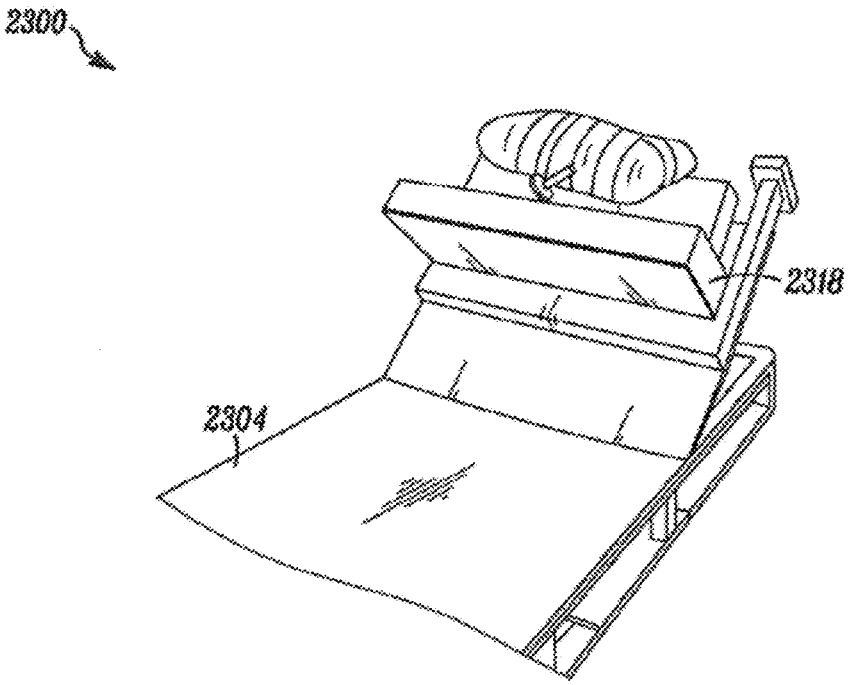
FIG. 10A depicts the adjustable bed facility supporting a weight on the head board and FIG. 10B depicts the adjustable bed facility supporting a weight on the head board and bed deck.
Figure 10B:
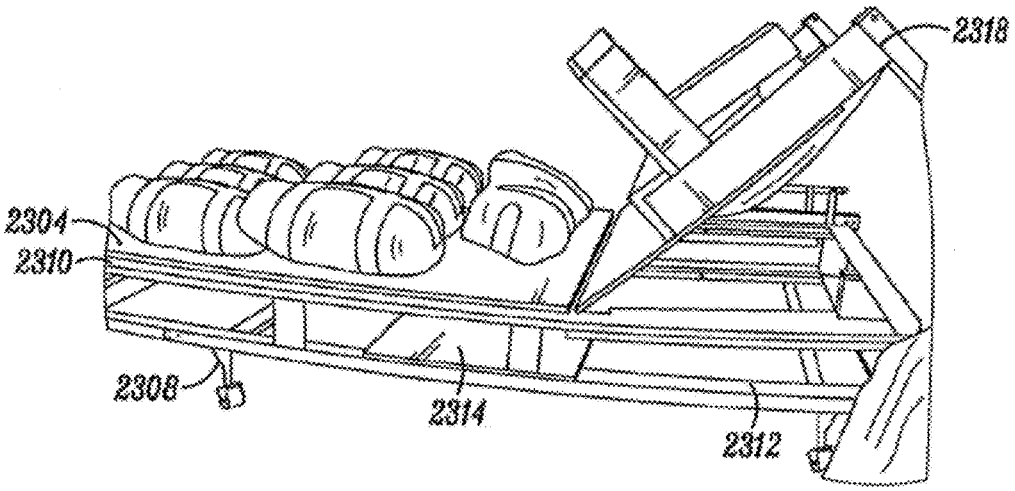

FIGS. 10A and 10B depict an alternate embodiment of the adjustable bed fame assembly with a truss-reinforced structure. In an embodiment, a steel skeleton may be disposed under the head and center of the adjustable bed facility 102. In an embodiment, the adjustable bed facility 102 may comprise a truss. The truss may be formed from at least two truss members that may be crossed to for an X shape. The truss may be disposed between the upper frame 2310 of the adjustable bed facility and the lower frame 2312 of the adjustable bed facility 102. For example, the truss may connect to the steel skeleton 114 and the foundation materials, such as oriented strand board (OSB), plywood, and the like, of the adjustable bed frame, which may comprise a bed deck 2304, head board 2318, upper frame 2310, lower frame 2312, and middle section 2314 (also known as center frame elsewhere). The truss members may be fastened together in the center of the X to give it more strength. The truss may box in a key area of the adjustable bed facility 102 and enable the adjustable bed facility 102 to support large amounts of weight.

In an embodiment, the adjustable bed facility 102 frame could be built with legs or without legs on the corners. If the adjustable bed facility 102 lacks legs, it can rest on a standard steel foundation 2308. Some steel foundations provide more support than others depending on where the crossbars are located, but the adjustable bed facility 102 may be operable with most steel foundations.

In an aspect, an adjustable bed facility 102 may comprise standard flat foundation materials. For example, the adjustable bed facility 102 may comprise wood strapping and 2.times.4s. In an alternative embodiment, the adjustable bed facility 102 may be made from any material, such as metal, steel, plastic, wood, fiberglass, and the like.

The adjustable bed facility 102 may support considerable weight. For example, in FIG. 10A, the head board 2318 is supporting 400 pounds of weight and in FIG. 10B, the head board 2318 of the adjustable bed facility 102 is supporting 400 pounds of weight and the bed deck 2304 is supporting 350 pounds. As can be seen in FIG. 10B, the adjustable bed facility 102 rests on and is supported on a standard steel foundation 2308. The truss 2402 may be disposed in the middle section 2314 between the lower frame 2312 and the upper frame 2310/bed deck 2304. The truss may be oriented such that the X shape formed by the truss is oriented along the length of the adjustable bed facility 102. In some embodiments, the truss 2402 may be oriented along the width of the adjustable bed facility 102. In some embodiments, the truss 2402 may be disposed anywhere along the bed deck 2304 portion of the adjustable bed facility 102. The truss 2402 may be connected to the skeleton 114, the bed deck 2304, the upper frame 2310, lower frame 2312, middle section 2314, or any combination thereof. In some embodiments, the actuator 104 may also be connected to the truss 2402.

In operation, when the adjustable bed facility is fully extended, the head board 2318 rests on the upper frame 2310 of the adjustable bed facility. When the adjustable bed facility 102 is operated, the head board 2318 may lift away from the upper frame 2310. For example, the head board 2318 and bed deck 2304 may be hinged or otherwise connected such that the head board 2318 is pivotally connected to the bed deck 2304. In some embodiments, the upper frame 2310, lower frame 2312, and bed deck 2304 may remain motionless. In other embodiments, the bed deck 2304 may be divided into a center frame and a leg frame portion so that there may be additional motions possible for the adjustable bed facility 102. In an embodiment, when the skeleton 114 is connected to the truss 2402, the weight of a user against the head board 2318 and bed deck 2304, either in the fully extended or head board-lifted positions, are more supported than if no truss 2402 were present.

Figure 11:
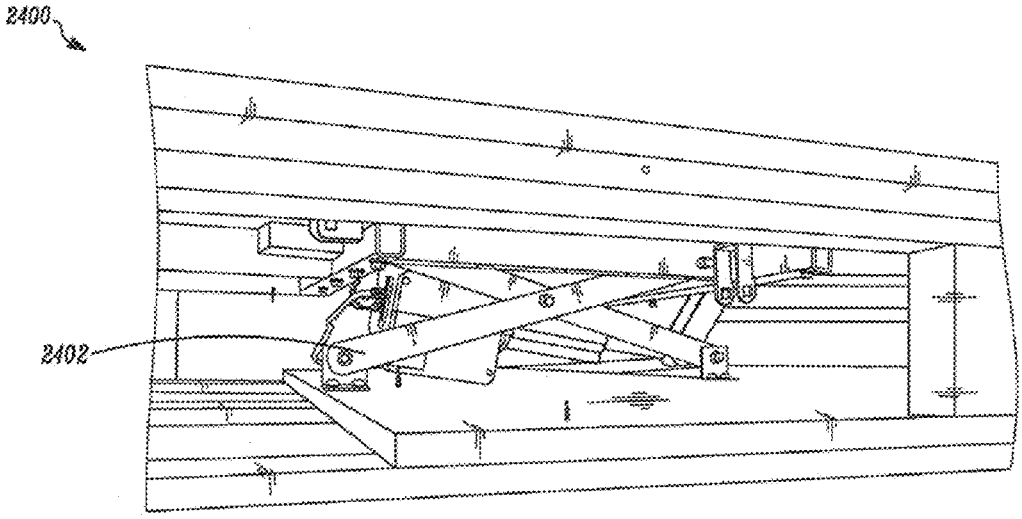
FIG. 11 depicts the truss structure of the adjustable bed facility.

Referring to FIG. 11, the truss 2402 is disposed between the upper frame 2310 and lower frame 2312 of the adjustable bed facility. In an embodiment, the truss is secured to both the upper frame 2310 and lower frame 2312 using a fastener, such as a screw, nail, bolt, staple, and the like. In some embodiments, the truss 2402 is secured to the bed deck 2304 as well.

Figure 12:
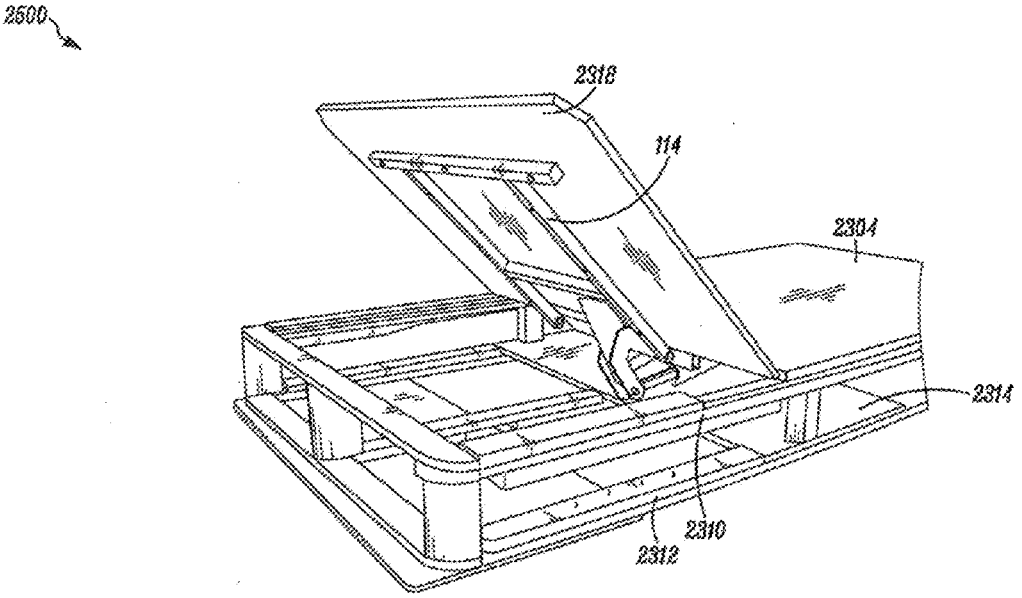
FIG. 12 depicts the steel skeleton of the adjustable bed facility.
Figure 13:
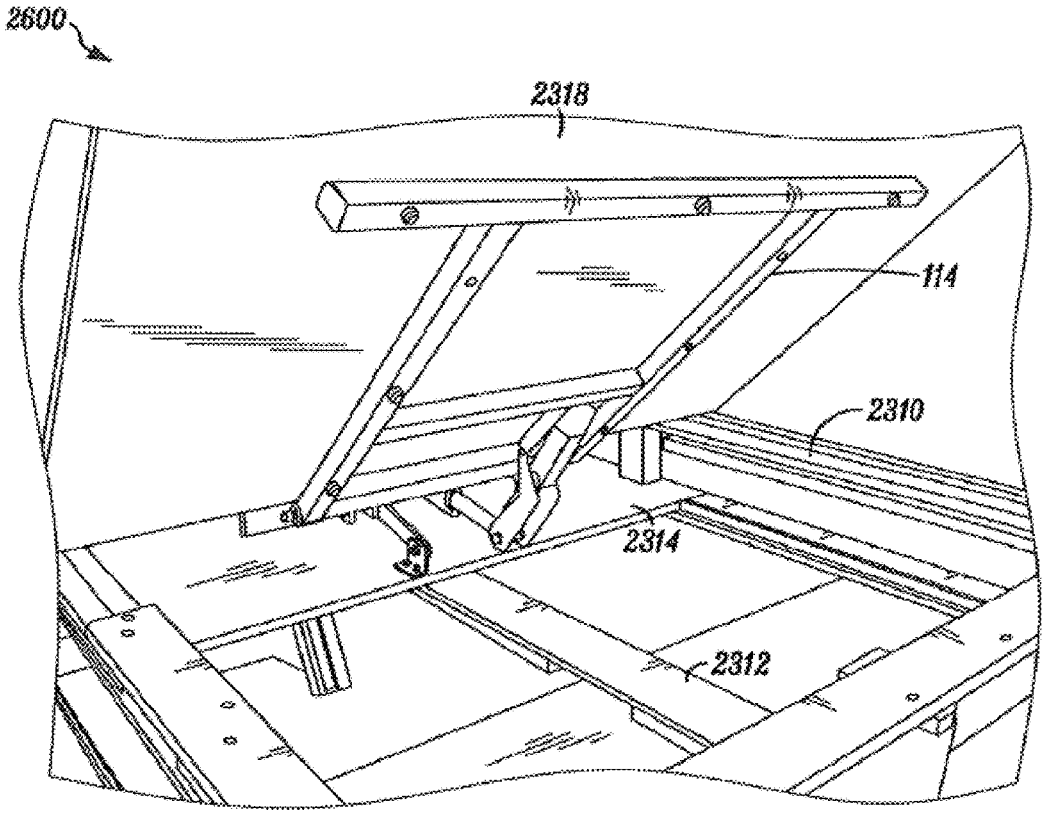
FIG. 13 depicts an alternate view of the steel skeleton of the adjustable bed facility.

Referring to FIG. 12, the adjustable bed facility 102 may comprise a skeleton 114. The skeleton 114 may provide structural support for the adjustable bed facility 102 and the physical connection between the head board 2318 and the lift facility (not shown). The skeleton 114 may be secured to the head board 2318 through certain attachment points, and secured to the middle section 2314, bed deck 2304, upper frame 2310 and/or lower frame 2312 using a fastener, such as a screw, nail, bolt, staple, and the like. The truss 2402 may be part of the skeleton 114. In FIG. 12, the adjustable bed facility 102 is shown in the lifted position, with the skeleton 114 attached to at least the head board 2318 and the middle section 2314. FIG. 13 shows an alternate angle of the adjustable bed facility 102 in a lifted position. The head frame portion of the skeleton attached to the head board 2318 includes parallel side frame members 2604 and a connecting frame member 2602. The head frame portion of the skeleton 114 may be pivotally connected 2608 to the skeleton 114 in a center portion of the bed. In embodiments, the connecting frame member 2602 may extend the width of the head board 2318.

Figure 14A:
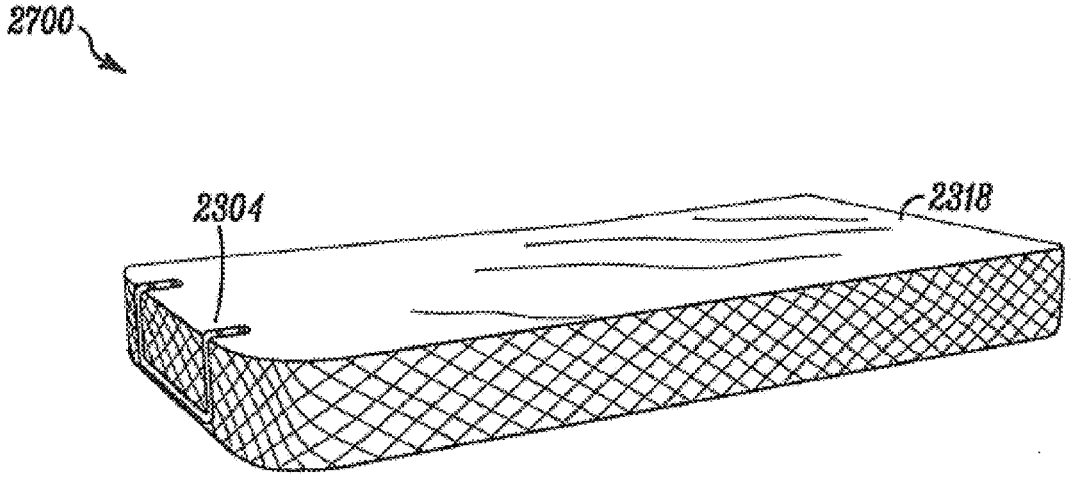
FIG. 14A and FIG. 14B depict a covered adjustable bed facility in the (FIG. 14A) fully extended and (FIG. 14B) head board lifted positions.
Figure 14B:
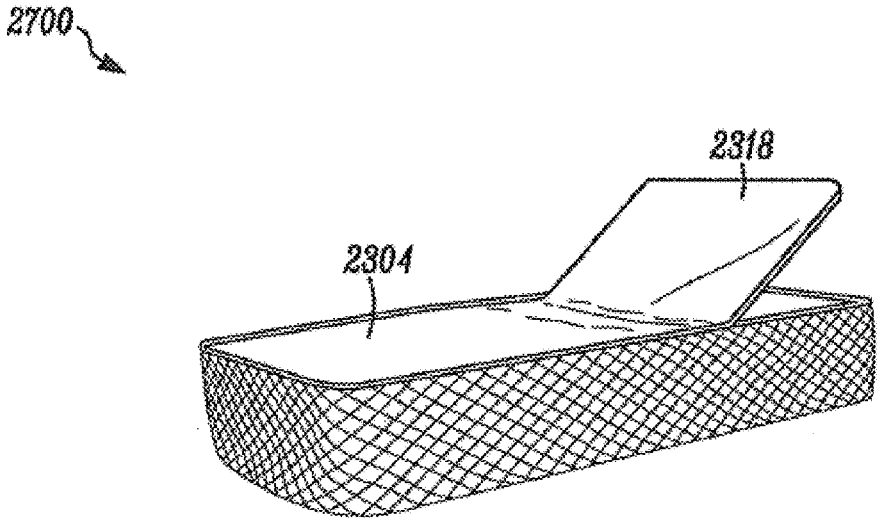

Referring to FIGS. 14A and 14B, the truss-reinforced adjustable bed facility 102 is shown with a mattress cover. The adjustable bed frame is covered with a mattress fabric. Additionally, the bed deck 2304 and head board 2318 may be additionally covered in a mattress cushioning for the user's comfort. In FIG. 14A, the head board 2318 is fully extended. In FIG. 14B, the head board 2318 has been lifted, as has been described herein. The head board 2318 lifts away from the upper frame 2310. For example, the head board 2318 and bed deck 2304 may be hinged such that the head board 2318 rotates around the axis of the hinges while the upper frame 2310, lower frame 2312, and bed deck 2304 remain motionless. In FIGS. 14A and 14B, the head board 2318 has its own covering so that when it lifts, the portion of the adjustable bed facility 102 that remains motionless is also covered.

The truss reinforced adjustable bed facility 102 may comprise any number of components described herein, such as actuators 104, springs 108, mattresses 110, a sub-frame 112, a skeleton structure 114, vibration motors 118, supports 120, safety brackets 122, an electronic facility 124, an air purification facility 144, a remote 148, a memory facility 150, a memory connection 160, a network connection 162, and the like. In an embodiment, the electronic facility 124 may include a wire harness 128, a receiver 130, modular controls 132, a control box 134, power outlets 138, a power connection 142, and the like. In an embodiment, the memory facility 150 may include a receiver learn facility 152, bed memory 154, a backup battery 158, and the like. In an embodiment, the receiver learn facility 152, bed memory 154, and backup battery 158 may not be part of the memory facility 150, but may be combined into other facilities or devices, be stand-alone devices, or the like. In an embodiment, the physical aspects of the truss-reinforced adjustable bed facility 102 that provide support for the user may include the actuators 104, springs 108, mattresses 110, a sub-frame 112, a skeleton structure 114, vibration motors 118, supports 120, and safety brackets 122.

Figure 15:
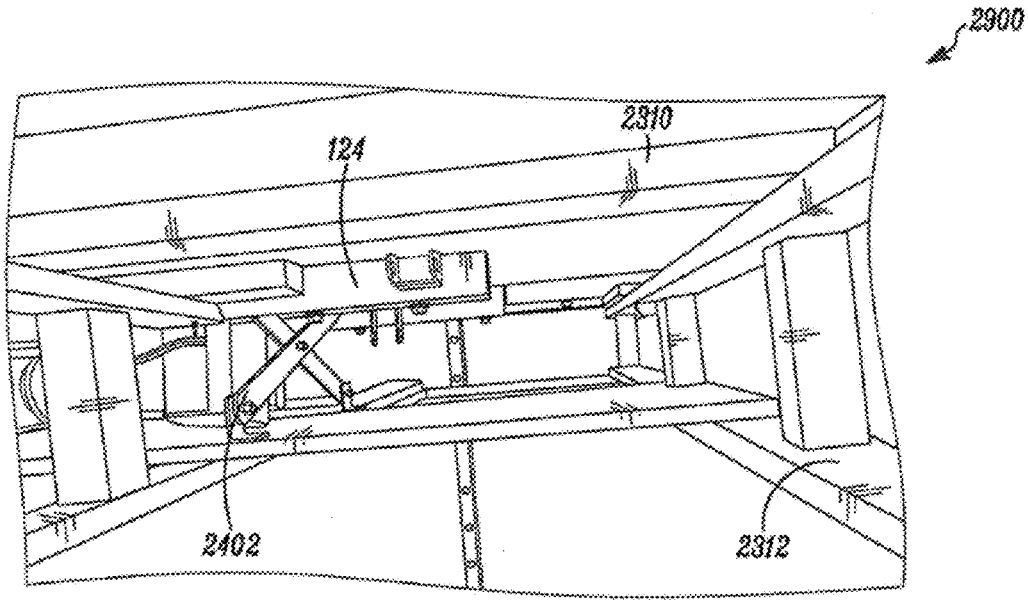
FIG. 15 depicts a view of the truss down the length of the adjustable bed frame.

Referring to FIG. 15, a view of the truss 2402 is shown looking down the center of the adjustable bed frame length-wise. The truss 2402 is attached to the middle section 2314, between the lower frame 2312 and the upper frame 2310/bed deck 2304.

Figure 16:
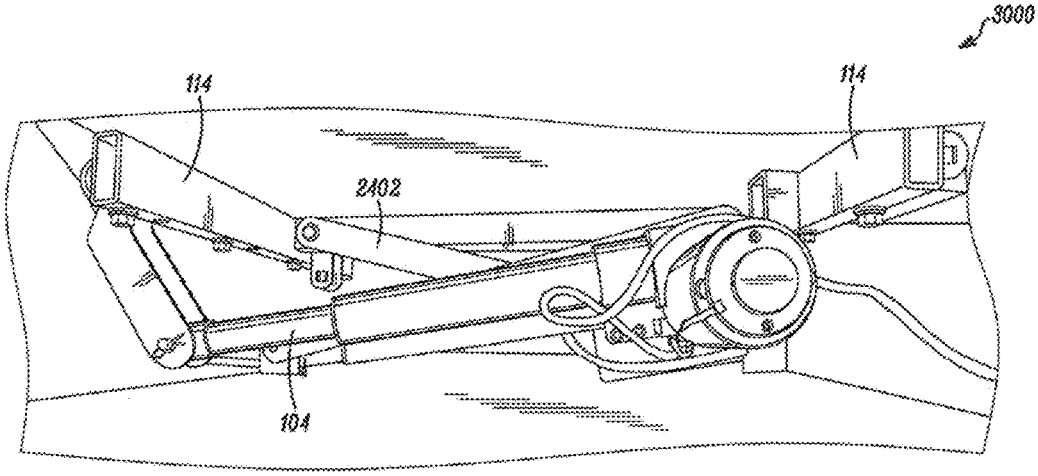
FIG. 16 depicts a view of the truss down the width of the adjustable bed frame.
Figure 17:
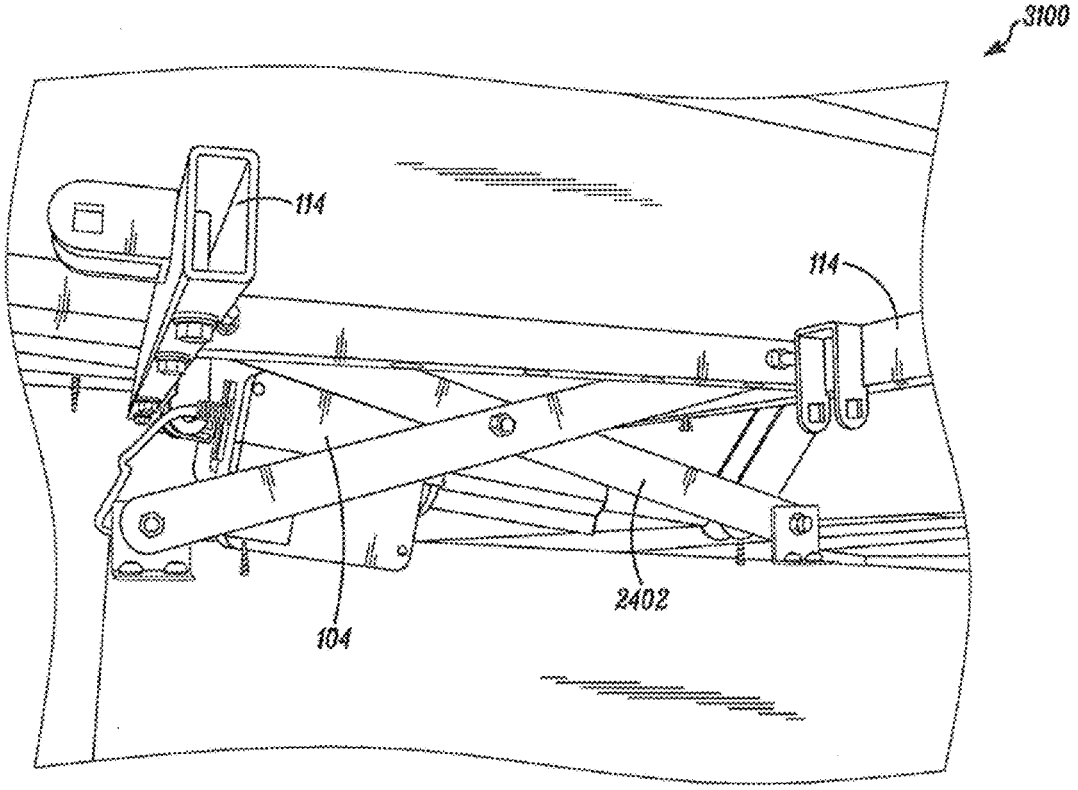
FIG. 17 depicts a view of the truss down the width of the adjustable bed frame.

Referring to FIG. 16, looking down the center of the adjustable bed frame width-wise, the truss 2402 is fastened to at least two places on the skeleton 114 and to the middle section 2314 of the adjustable bed frame. An actuator 104 is shown in the foreground, partially obstructing the view of the truss 2402. Referring to FIG. 17, the truss 2402 is now seen from the opposite side of the adjustable bed frame, still looking down the center width-wise. The fastener at the center of the X structure of the truss 2402 is clearly visible in this view.

Figure 18A:
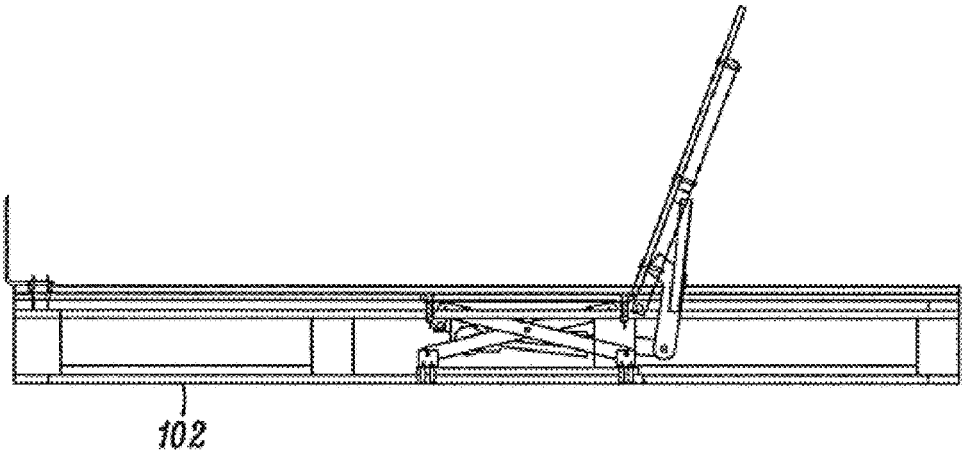
FIG. 18A, FIG. 18B, and FIG. 18C depict different structural views of the adjustable bed facility in accordance with an embodiment.
Figure 18B:
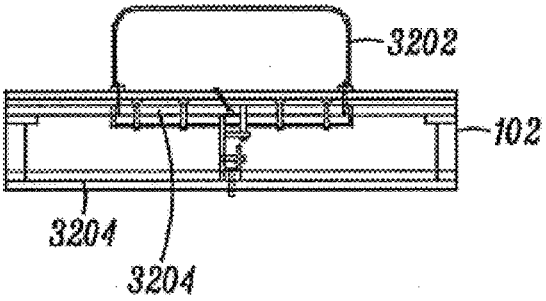
Figure 18C:
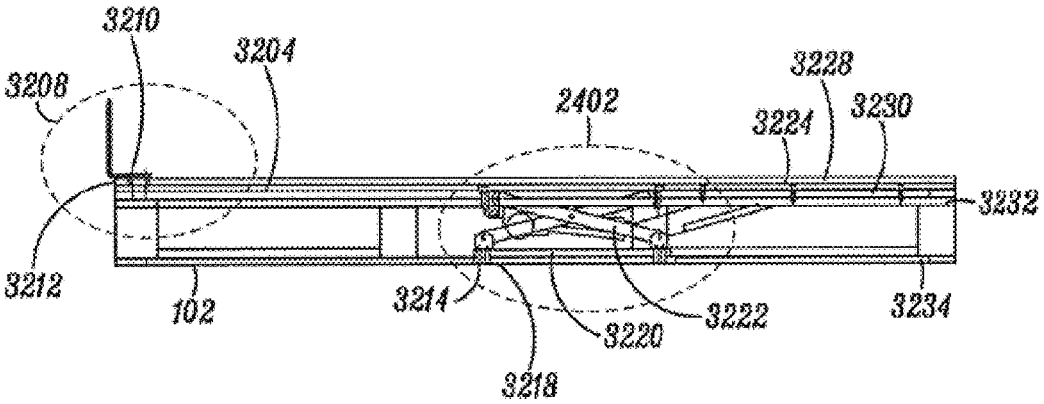

In embodiments, referring to FIG. 18A and FIG. 18B, structural views of the adjustable bed facility 102 may be provided. The adjustable bed facility may have a mattress support section 3208 and a truss 2402. As shown in FIG. 18C, the mattress support section may have a screw 3210 to tighten/loosen the mattress retained by bar 3202. In embodiments, the screw may be a wooden screw 3212. In addition, a foot and back deck 3204 is also represented in the FIG. 18C. Moreover, FIG. 18C represents a rail 3230, rail 3232, foam 3228, cross bars 3234, decks 3224, and the like. In embodiments, the rail 3230 may have a 19 mm*32.5 mm as its dimensions. In embodiments, the rail 3232 may have 19 mm*65 mm as its dimensions. These structural elements may support the adjustable bed facility 102. The deck 3224 may be made up of wood, plastic, and the like.

Figure 18D:
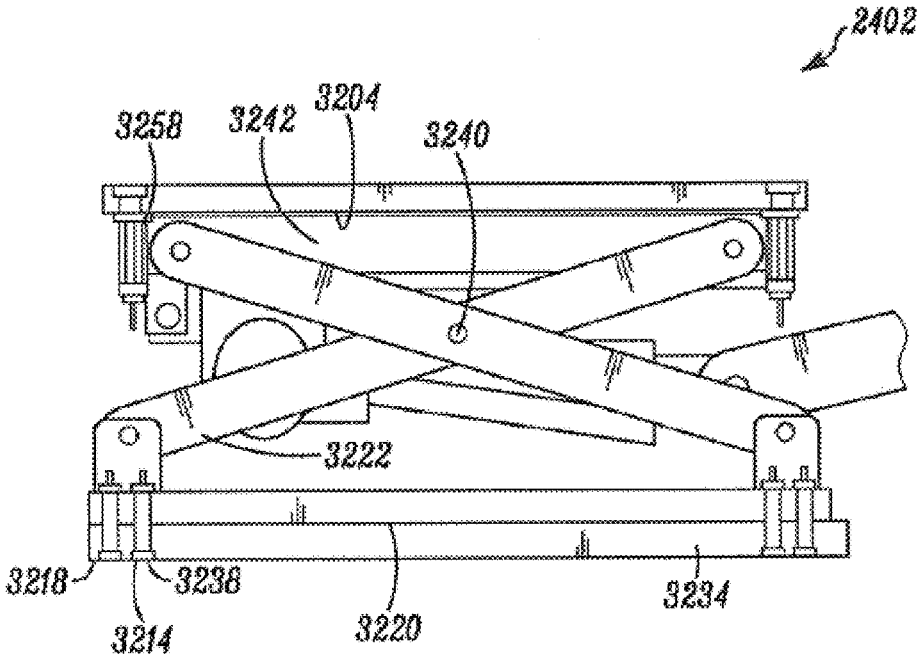
FIG. 18D and FIG. 18E depict the different structural views of the truss of the adjustable bed facility in accordance with an embodiment.
Figure 18E:
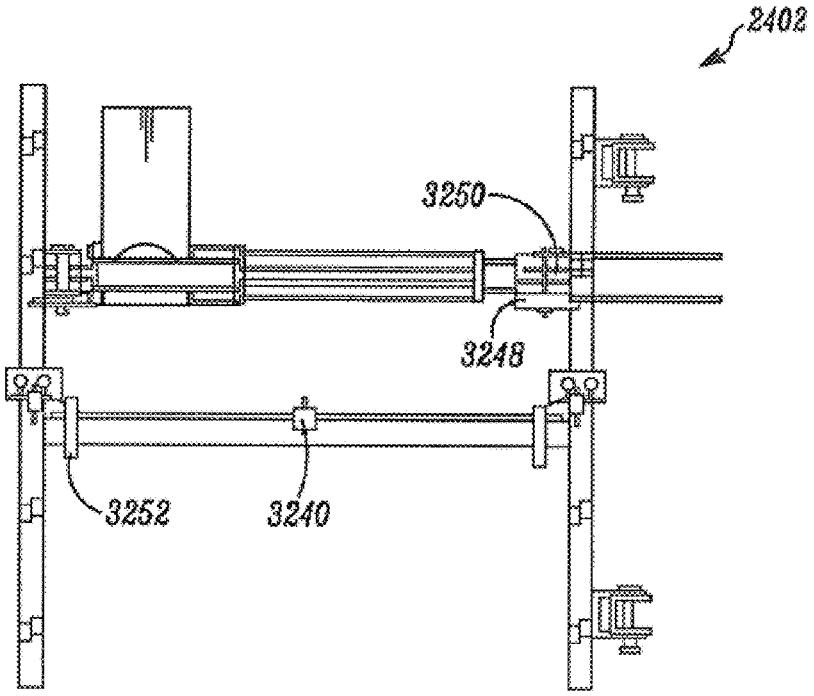

In embodiments, as shown in FIG. 18C, FIG. 18D, and FIG. 18E, the truss 2402 may include lower deck 3220, stabilizing bar 3222, an 'L' bracket 3218, a screw 3214, a tee nut 3238, a shoulder screw 3240, a vertical bar 3242, a bottom rail 3234, cross bars 3258, a plastic washer 325, an 'R' clip 3248, a motor pin 3250, and the like. In embodiments, as shown in FIG. 18E, the stabilizing bars 3222 may be connected to the bottom rail 3234 using the tee nut 3238, 'L-bracket' 3238, and the screw 3214. The stabilizing bars 3222 may be crossly connected to each other by using the shoulder screw 3234. The foot and back deck 3204 and the vertical bar 3242 may support the stabilizing bars 3222. In embodiments, the stabilizing bars 3222 may support the adjustable bed facility 102. For example, the user may put a heavy load on the adjustable bed facility 102. The stabilizing bar 3222 and the cross bars 3258 may absorb the pressure of the heavy load and may stabilize the adjustable bed facility 102. In embodiments, as explained above, the truss 2402 may help the bed to attain the position in the FIG. 18A from the FIG. 18D.

Rawls-Meehan U.S. Pat. Nos. 7,321,811, 7,465,280, 7,805,785, 7,930,783, 7,933,669, 7,979,169, 8,019,486, 8,032,263, 8,032,960, 8,046,114, 8,046,115, 8,046,116, 8,046,117, 8,050,805, 8,069,512, 8,078,336, 8,078,337, 8,150,562, 8,375,488, 8,565,934, and 8,682,457 as well as Rawls-Meehan U.S. Publication No. 2012/0057685 and 2014/0325761 are incorporated herein by reference in their entireties and variously disclose mattresses including foam springs or foam cells and materials/configurations therefor, adjustable bed assemblies including adjustable mattress frames, electrical, mechanical, and electronic components associated therewith, and remote controls for use therewith, all of which may be used individually or collectively in combination with the adjustable bed described herein.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the compositions, processes, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

ADJUSTABLE FOUNDATION PARTS LIST

10 adjustable foundation (or adjustable mattress support facility; including mattress support 1100, adjustable base frame 1200)

1100 mattress support (or deck)

1110 deck support (or board) section (first through fifth sections 1110A-E as head, bottom, first leg, second leg, and foot support or board portions; head section can be adjusted or articulated, bottom section is stationary and in a fixed position relative to the frame 1200, leg and foot sections can be stationary or adjustable)

1112 top surface of deck support (first through fifth sections 1112A-E as for deck support)

1120 mattress retainer bar

1200 adjustable bed frame or substructure support assembly or skeleton structure

1210 fixed base frame (longitudinally opposed 1210A head and 1210D foot end sections, laterally opposed 1210B and 1210C side sections)

1212, 1214 top and bottom surfaces or boundaries of base frame 1210

1220 longitudinal support member

1230 lateral support member (first through third member 1230A head, 1230B bottom, and 1230C leg/foot)

1232, 1234 top and bottom surfaces of lateral support member 1230

1240 vertical support member

1250 (metal) adjustable support or skeleton frame (1250A head section, 1250B leg section, 1250C foot section)

1252 articulating portion of adjustable support frame 1250 (e.g., hingedly or pivotally attached to support portion 1254; includes 1256 longitudinal frame member, 1258 lateral frame member)

1254 (fixed) support portion of adjustable support frame 1250

1260 (metal) support (e.g., bar or bracket) structure connected to support portion 1254 of frame 1250 and top surface 1232 of lateral support member 1230

1270 actuator or movement/articulation means or assembly (first and second ends 1272, 1274)

X lateral direction

Y longitudinal direction

What is claimed is:

1. An adjustable bed foundation comprising: (a) a mattress support comprising (i) a first adjustable deck support section, and (ii) a second stationary deck support section adjacent the first adjustable deck support section; (b) an adjustable base frame positioned below the mattress support, the adjustable base frame comprising: (i) a fixed base frame; (ii) a longitudinal support member spanning the fixed base frame; (iii) at least two lateral support members longitudinally spaced apart and spanning the fixed base frame; and (iv) a first adjustable support frame comprising a first support portion and a first articulating portion pivotally connected to the first support portion, the first support portion being mounted to at least one of the lateral support members; and (c) a first actuator positioned below the mattress support, the first actuator having a first end connected to the first support portion of the first adjustable support frame and a second end connected to the first articulating portion of the first support frame; wherein the first adjustable deck support section is mounted to the first articulating portion of the first adjustable support frame; and the second stationary deck support section is mounted to the adjustable base frame and remains fixed in position relative to the fixed base frame; wherein: the longitudinal support member is spaced below a top boundary of the fixed base frame; and the lateral support members are positioned between the longitudinal support member and the top boundary of the fixed base frame, the longitudinal support member being mounted to and providing vertical support to the lateral support members.

2. The adjustable foundation of claim 1, wherein the lateral support members have a height less than that of the fixed base frame and are positioned to provide an open area between the lateral support members and a bottom boundary of the fixed base frame.

3. The adjustable foundation of claim 1, wherein one or more of the fixed base frame, the longitudinal support member, the lateral support members, and the mattress support comprises wood.

4. The adjustable foundation of claim 1, wherein the first adjustable support frame comprises metal.

5. The adjustable foundation of claim 1, wherein the mattress support further comprises one or more additional stationary deck support sections mounted to the adjustable base frame and remaining fixed in position relative to the fixed base frame.

6. The adjustable foundation of claim 1, wherein:

the mattress support further comprises (iii) a third adjustable deck support section adjacent the second stationary deck support section;

the adjustable base frame further comprises (v) a second adjustable support frame comprising a second support portion and a second articulating portion pivotally connected to the second support portion, the second support portion being mounted to at least one of the lateral support members;

the adjustable foundation further comprises (d) a second actuator positioned below the mattress support and having a first end connected to the first support portion of the first adjustable support frame and a second end connected to the second articulating portion of the second support frame; and the third adjustable deck support section is mounted to the second articulating portion of the second adjustable support frame.

7. The adjustable foundation of claim 6, wherein:

the mattress support further comprises (iv) a fourth adjustable deck support section adjacent the third adjustable deck support section and is pivotally connected thereto;

the adjustable foundation further comprises at least a third lateral support member longitudinally spaced apart and spanning the fixed base frame; and the adjustable base frame further comprises (vi) a third adjustable support frame comprising a third support portion and a third articulating portion pivotally connected to the third support portion, the third support portion being mounted to at least one of the lateral support members.

8. The adjustable foundation of claim 7, wherein at least one of the second adjustable support frame and the third adjustable support frame comprises metal.

9. An adjustable bed foundation comprising: (a) a stationary deck having a top surface for supporting a mattress; (b) an adjustable head board positioned adjacent to the stationary deck at or near a pivot point, the head board defining a top surface to further support a head portion of the mattress and being operable to pivot about the pivot point to a range of positions from a flat position, a raised position, and positions therebetween; (c) a substructure support assembly mounted directly below the stationary deck and head board, the substructure comprising: (i) an actuator support structure mounted directly below the stationary deck; (ii) a head board support structure mounted directly below the head board and operable to pivot with the head board; (iii) two or more lateral support beams spaced apart and positioned below the stationary deck operable for supporting and mounting of the actuator support structure; and (iv) a longitudinal support beam generally bisecting the lateral support beams and extending the length of the stationary deck and head board and operable to support the lateral support beams and the head board and actuator support structures; and (d) an actuator mounted to the actuator support structure and connected to the head board support structure through a linkage and adapted to raise and lower the head board upon actuation.

10. The adjustable foundation of claim 9, wherein:

the longitudinal support beam is spaced below a top boundary of the substructure support assembly; and the lateral support beams are positioned between the longitudinal support beam and the top boundary of the substructure support assembly, the longitudinal support beam being mounted to and providing vertical support to the lateral support beams.

11. The adjustable foundation of claim 9, wherein the lateral support beams have a height less than that of the substructure support assembly and are positioned to provide an open area between the lateral support beams and a bottom boundary of the substructure support assembly.

12. The adjustable foundation of claim 9, wherein the longitudinal support beam, the lateral support beams comprises wood.

13. The adjustable foundation of claim 9, wherein the head board support structure comprises metal.

* * * * *